US007861687B2

(12) United States Patent
Hamasaki et al.

(10) Patent No.: US 7,861,687 B2
(45) Date of Patent: Jan. 4, 2011

(54) MULTIPLE THROTTLE DEVICE

(75) Inventors: Daisuke Hamasaki, Odawara (JP); Atsushi Osanai, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 12/656,460

(22) Filed: Jan. 29, 2010

(65) Prior Publication Data

US 2010/0132663 A1 Jun. 3, 2010

Related U.S. Application Data

(63) Continuation of application No. PCT/JP2008/063741, filed on Jul. 31, 2008.

(30) Foreign Application Priority Data

Jul. 31, 2007 (JP) ..... 2007-199308

(51) Int. Cl.
*F02D 9/10* (2006.01)

(52) U.S. Cl. ..... 123/336; 123/583; 123/337

(58) Field of Classification Search ..... 123/336, 123/337, 583
See application file for complete search history.

(56) References Cited

U.S. PATENT DOCUMENTS

| | | | | |
|---|---|---|---|---|
| 4,823,748 | A * | 4/1989 | Ampferer et al. | 123/336 |
| 5,803,044 | A * | 9/1998 | Kato | 123/336 |
| 7,533,653 | B2 * | 5/2009 | Hotta | 123/336 |
| 7,597,086 | B2 * | 10/2009 | Kuji et al. | 123/336 |
| 7,726,280 | B2 * | 6/2010 | Nishimura et al. | 123/399 |
| 2004/0154598 | A1 | 8/2004 | Suda et al. | |
| 2006/0042589 | A1 | 3/2006 | Hanasato | |
| 2006/0231069 | A1 | 10/2006 | Hanasato | |
| 2008/0184958 | A1 * | 8/2008 | Sato et al. | 123/336 |

FOREIGN PATENT DOCUMENTS

| | | |
|---|---|---|
| JP | 2002-256900 | 9/2002 |
| JP | 2004-132289 | 4/2004 |
| JP | 2004-132290 | 4/2004 |
| JP | 2005-207549 | 8/2005 |

OTHER PUBLICATIONS

International Search Report for PCT/JP2008/063741, mailed Aug. 26, 2008.

* cited by examiner

*Primary Examiner*—Erick Solis

(57) ABSTRACT

A compact multiple throttle device where multiple throttle shafts are driven by a single drive force. A throttle device includes a first throttle shaft to which a first throttle body and a third throttle body are fixed and also includes a second throttle shaft to which a second throttle body and a fourth throttle body are fixed. The first throttle shaft and the second throttle shaft are parallel to each other. The third throttle body and the fourth throttle body are integrally coupled to each other in a gear case. In the inside of the gear case, a motor for driving the first throttle shaft and the second throttle shaft is arranged. Further, first to sixth gears for transmitting drive force of the motor to the first throttle shaft and the second throttle shaft are included.

19 Claims, 6 Drawing Sheets

MULTIPLE THROTTLE DEVICE

CROSS-REFERENCE TO RELATED APPLICATIONS

This application is a continuation, filed under 35 U.S.C. §111(a), of PCT international application No. PCT/JP2008/063741, filed Jul. 31, 2008, which application claims the priority benefit of Japanese patent application No. 2007-199308, filed Jul. 31, 2007, the disclosures of which are incorporated herein by reference.

BACKGROUND

1. Field

The present invention relates to a multiple throttle device that is connected to intake ports of an engine and controls volumes of air to be supplied to the intake ports. Particularly, the present invention relates to a multiple throttle device connected to a V-type engine having four or more cylinders.

2. Description of the Related Art

As the displacement of a vehicle engine and the number of cylinders thereof are being increased, a V-type engine is frequently adopted as the vehicle engine from viewpoints of a mounting space and weight reduction thereof.

When a body of the engine becomes compact, naturally, a requirement for also downsizing the respective instruments fixed to the engine body is increased. Among the instruments, a throttle device occupies a major position. In particular, in a motorcycle engine, a large restriction is imposed on a mounting space of the throttle device. Accordingly, it is beneficial that the throttle device be downsized as well as the engine body.

In recent years, an electronic control system has been adopted in place of the conventional carburetor system in the motorcycle. With regard to throttle valves of throttle bodies, a rotation angle of a throttle shaft is controlled by a throttle position sensor (TPS), and the throttle shaft is driven by a direct current (DC) motor. In the case where the number of throttle shafts is two as in the V-type engine, two DC motors are used. In general, it is necessary to adjust (hereinafter, simply referred to as "synchronize") openings of the throttle valves in order to properly set rotation of the engine at the time of idling. Such synchronization is performed by a synchronization mechanism that rotates the throttle shaft. However, in the case where the number of throttle shafts is two as in the V-type engine, when the synchronization is performed for each of the throttle shafts, the throttle shafts may go out of mutual synchronization and turn into different synchronization states. Accordingly, for the purpose of preventing such a synchronization shift, a configuration is disclosed, in which two throttle shafts are link-coupled to each other by a joint rod, and the synchronization in one of the throttle shafts is reflected on the other throttle shaft as disclosed in Japanese Patent Application Laid-open No: 2004-239234.

However, in a configuration of driving such a multiple throttle device by the plurality of DC motors, weight of an entire apparatus is increased. Further, from the viewpoint of an installing space and cost of the DC motors, it is preferred that the DC motors be combined into one unit. Further, in the case where multiple DC motors are used, it is necessary to synchronize not only the throttle shafts with each other but also motions of the DC motors themselves with each other, and there is a problem that it is difficult to accurately synchronize the motions of the DC motors with each other. With regard to the synchronization between the throttle shafts, the two throttle shafts may be link-coupled to each other by the joint rod as in JP 2004-239234 A. However, such a structure should be avoided from a viewpoint of preventing vibrations, a viewpoint that the synchronization is prone to be shifted owing to an external impact, and the like.

SUMMARY

In view of the foregoing, it is an aspect of the present invention to provide a compact multiple throttle device that drives multiple throttle shafts by one drive force.

Additional aspects and/or advantages will be set forth in part in the description which follows and, in part, will be apparent from the description, or may be learned by practice of the invention.

The foregoing and/or other aspects are achieved by a multiple throttle device including: two throttle shafts, each being rotatably supported on two or more throttle bodies; drive force transmission means, which is arranged between the two or more throttle bodies rotatably supporting the same throttle shaft, and transmits drive force of drive means to the two throttle shafts; and a drive force transmission means housing case that houses the drive force transmission means therein, and couples two throttle bodies to each other, the two throttle bodies being individually fixed to the two throttle shafts different from each other.

Further, the drive means may be installed in an area surrounded by four pieces of the throttle bodies.

Still further, the drive force transmission means may include gears.

Yet further, the multiple throttle device may include a synchronization mechanism fixed to one of the two throttle shafts. The synchronization mechanism may synchronize, to each other, sets of the throttle bodies, which rotatably support the different two throttle shafts in such a manner that a mesh degree of the gears is adjusted by a synchronization screw.

Yet further, the synchronization mechanism may include: a first adjustment section that is fixed to the one of the two throttle shafts, and is extended from the drive force transmission means housing case; and a second adjustment section, which has an operation portion receiving an adjustment operation, is fixed to the one of the two throttle shafts, and fits to the first adjustment section.

Yet further, the synchronization mechanism may include urging means that retains the fitting between the first adjustment section and the second adjustment section.

Yet further, the first adjustment section and the second adjustment section may be taper-fitted to each other.

According to the present invention, a compact multiple throttle device that drives multiple throttle shafts by one drive force can be realized.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
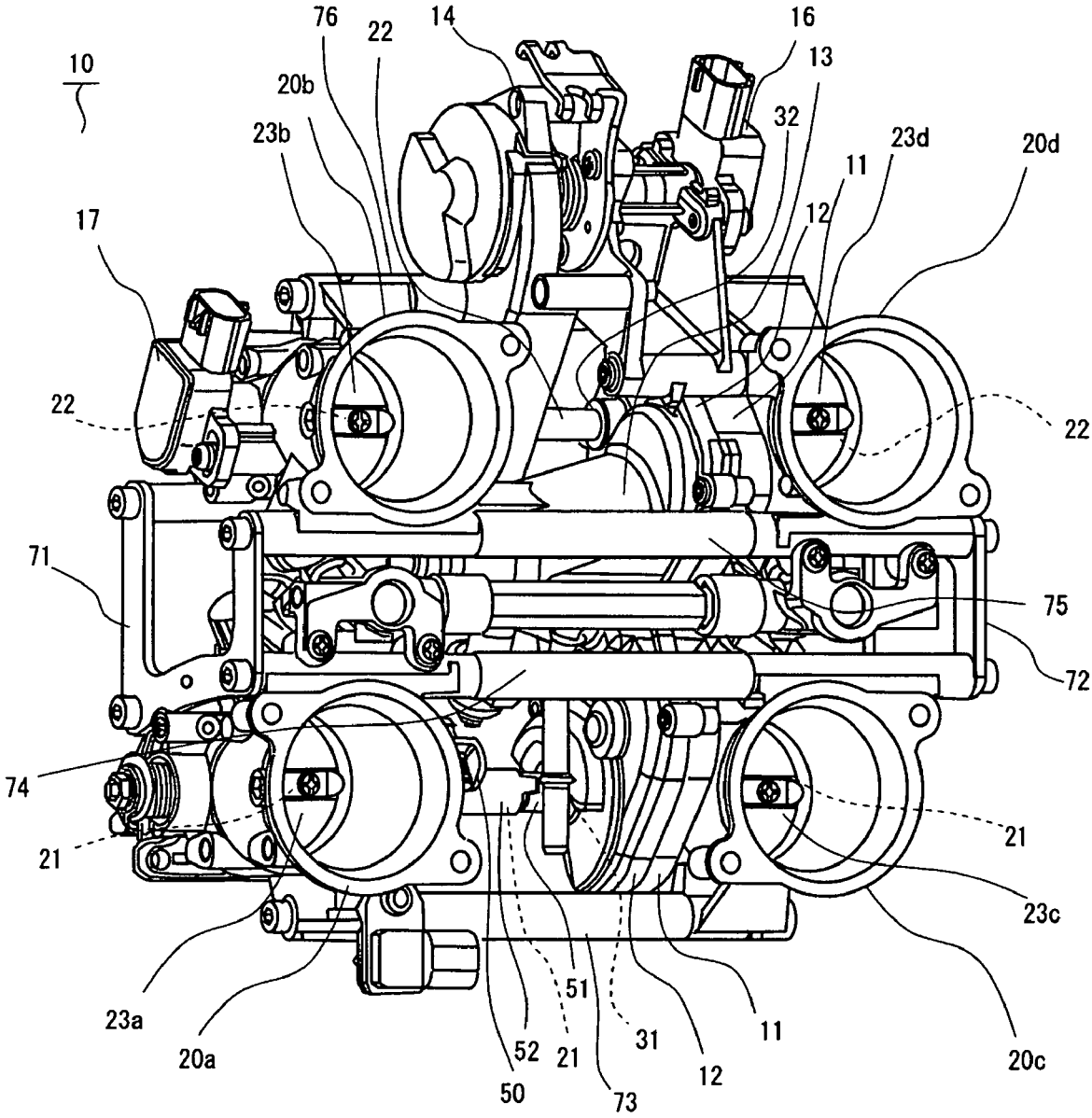
FIG. 1 is a perspective view of a throttle device according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Figure 2:
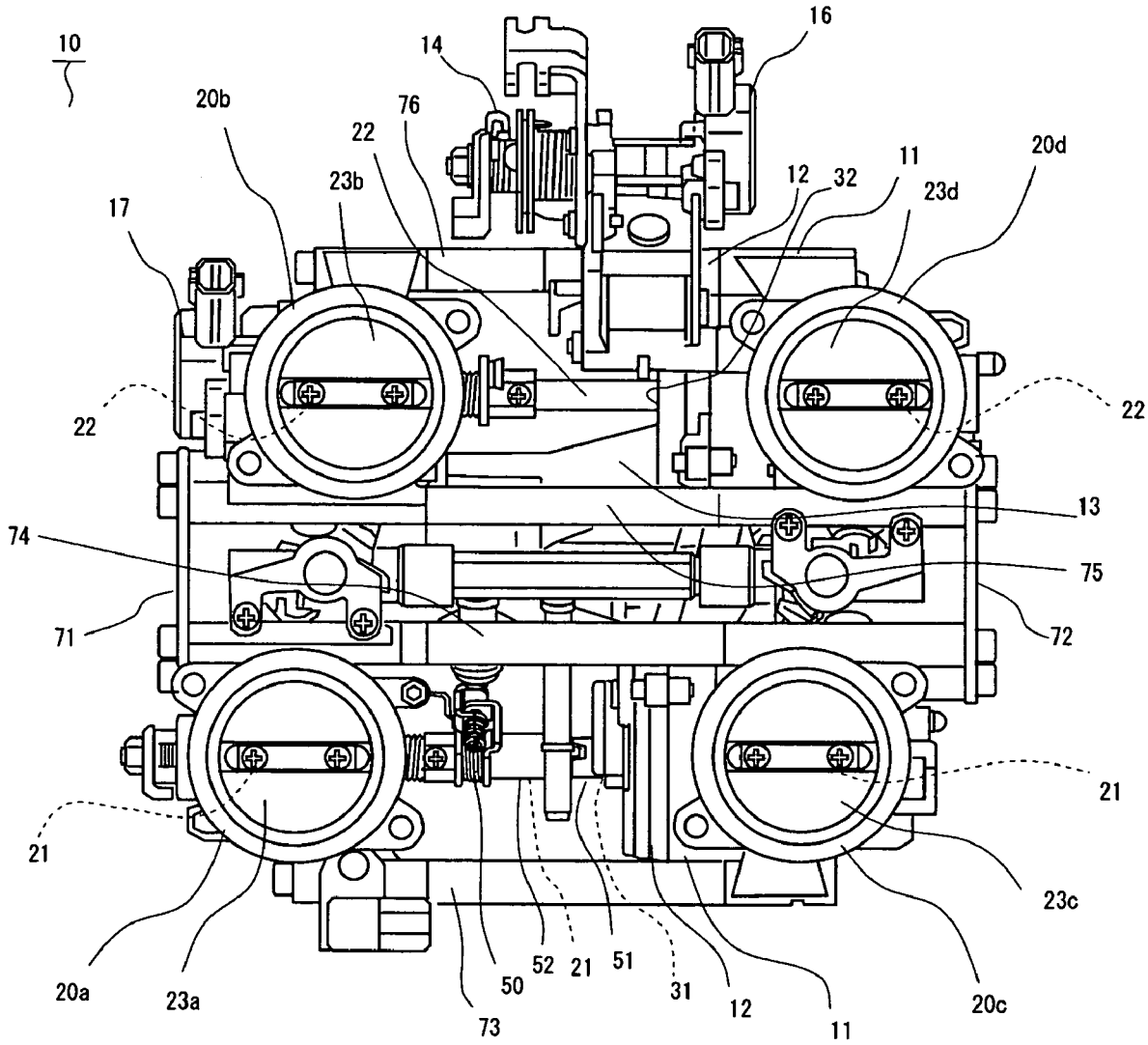
FIG. 2 is a plan view of the throttle device according to the embodiment.

FIG. 1 is a top perspective view of a throttle device 10 according to an embodiment. FIG. 2 is a plan view of the throttle device 10.

The throttle device 10 is formed of multiple components (throttle bodies and the like). To be more specific, the throttle device 10 is formed of four throttle bodies and the like, and is fixed to a four-cylinder V-type engine (not shown) of a motorcycle.

The throttle device 10 includes four throttle bodies, which are first to fourth throttle bodies 20*a* to 20*d*. Hereinafter, when the first to fourth throttle bodies 20*a* to 20*d* are not distinguished from one another, the throttle bodies are simply referred to as throttle bodies 20. The first to fourth throttle bodies 20*a* to 20*d* include first to fourth throttle valves 23*a* to 23*d*, respectively.

In the drawings, the first throttle body 20*a* is arranged on a lower left side, the second throttle body 20*b* is arranged on an upper left side, the third throttle body 20*c* is arranged on a lower right side, and the fourth throttle body 20*d* is arranged on an upper right side.

As illustrated in the drawings, the throttle device 10 includes a first throttle shaft 21 and a second throttle shaft 22, which are arranged up and down in parallel to each other. The first throttle valve 23*a* of the first throttle body 20*a* and the third throttle valve 23*c* of the third throttle body 20*c* are fixed to the first throttle shaft 21. The first throttle valve 23*a* and the third throttle valve 23*c* operate to open and close as the first throttle shaft 21 is rotating. Note that the first throttle shaft 21 is rotatably supported on the first throttle body 20*a* and the third throttle body 20*c*. In a similar way, the second throttle valve 23*b* of the second throttle body 20*b* and the fourth throttle valve 23*d* of the fourth throttle body 20*d* are fixed to the second throttle shaft 22. The second throttle valve 23*b* and the fourth throttle valve 23*d* operate to open and close as the second throttle shaft 22 is rotating. Note that the second throttle shaft 22 is rotatably supported on the second throttle body 20*b* and the fourth throttle body 20*d*.

Figure 3:
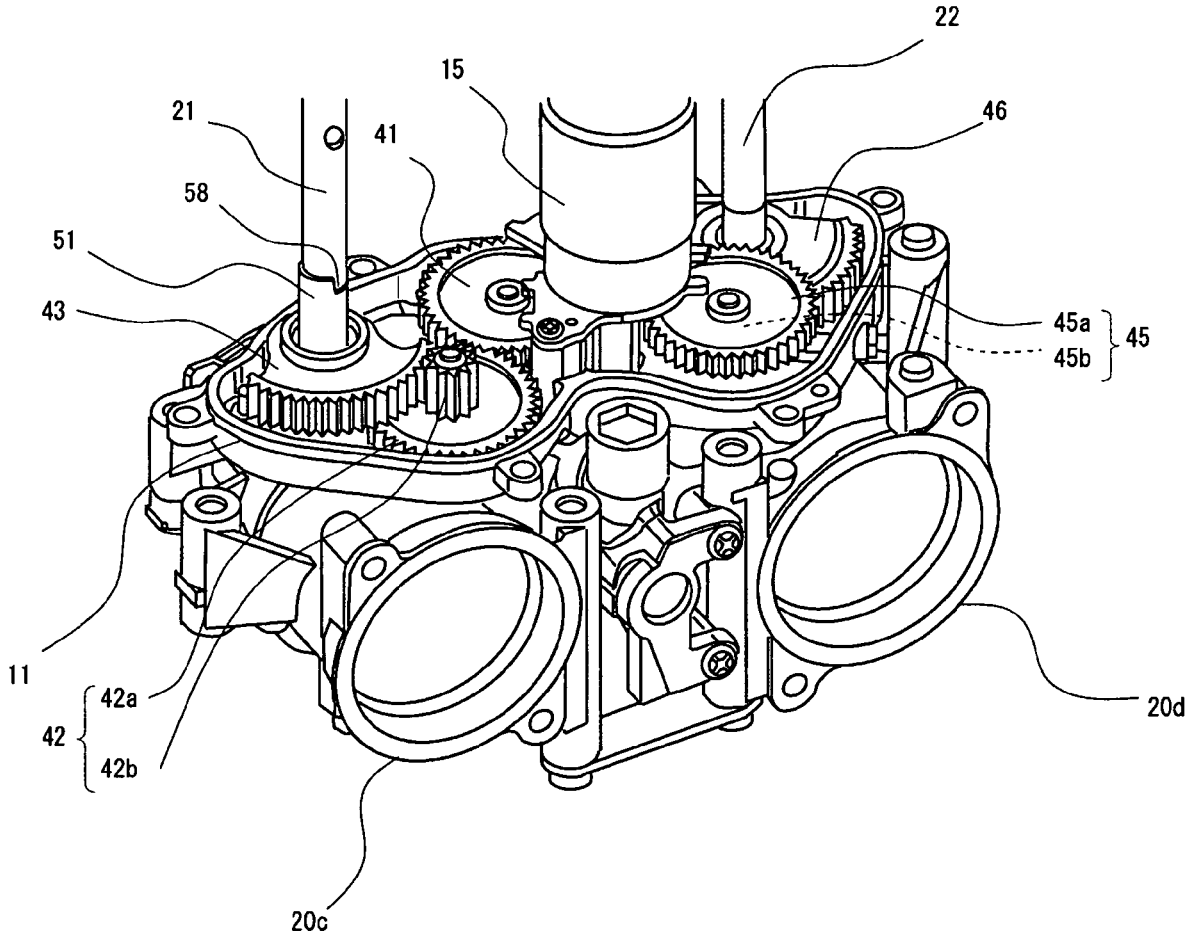
FIG. 3 is a view illustrating an internal configuration of a gear case according to the embodiment.

The third throttle body 20*c* and the fourth throttle body 20*d* are integrally coupled to each other by a gear case 11. Although described later in detail, as illustrated in FIG. 3, in an inside of the gear case 11, a motor 15 is arranged, which drives the first throttle shaft 21 and the second throttle shaft 22. Further, the gear case 11 includes first to sixth gears 41 to 46 (for the fourth gear 44, refer to FIG. 4) which transmit drive force of the motor 15 to the first throttle shaft 21 and the second throttle shaft 22.

As described above, a configuration is adopted, in which the one motor 15 is provided as a unit that drives the first throttle shaft 21 and the second throttle shaft 22. Accordingly, weight of the throttle device 10 can be reduced more than in a configuration in which two motors are provided. Further, the motor 15 is arranged in a space surrounded by the four throttle bodies 20, and hence the throttle device 10 can be made compact. Still further, such constituents which are relatively heavy are arranged on a center side of the throttle device 10, and accordingly, a center of gravity of the throttle device 10 can be arranged closer to the center, and a center of gravity of the engine onto which the throttle device 10 is to be mounted can be arranged closer to the center. In other words, the above-mentioned configuration can contribute, for example, to enhancement of kinematic performance of the motorcycle.

Returning to FIGS. 1 and 2, as illustrated therein, a gear cover 12 including a motor housing portion 13 that has a protruding shape is fixed to the gear case 11. In the gear cover 12, first and second shaft holes 31 and 32 are formed. The first throttle shaft 21 is extended from the first shaft hole 31, and the second throttle shaft 22 is extended from the second shaft hole 32.

The first throttle body 20*a* and the third throttle body 20*c* are coupled to each other by first and second mounting shafts 73 and 74. In a similar way, the second throttle body 20*b* and the fourth throttle body 20*d* are coupled to each other by third and fourth mounting shafts 75 and 76.

Onto left sides of the first throttle body 20*a* and the second throttle body 20*b*, a first bracket 71 that couples the first throttle body 20*a* and the second throttle body 20*b* to each other is fixed. In a similar way, onto right sides of the third throttle body 20*c* and the fourth throttle body 20*d*, a second bracket 72 is fixed, onto which the third throttle body 20*c* and the fourth throttle body 20*d* are to be fixed.

A throttle conversion unit 14 is fixed to the fourth mounting shaft 76 that couples the second throttle body 20*b* and the fourth throttle body 20*d* to each other. The throttle conversion unit 14 converts, into an amount of rotation, an amount of operation by a user to a throttle wire (not shown) extended from the throttle conversion unit 14. A first TPS 16 coaxially fixed to the throttle conversion unit 14 senses the amount of operation, which is converted into the amount of rotation. Then, the motor 15 is driven in response to the amount of rotation, which is sensed by the first TPS 16. As described above, the drive force of the motor 15 is transmitted to the first and second throttle shafts 21 and 22 by the first to sixth gears 41 to 46. Note that a second TPS 17 that is fixed to a left end portion of the second throttle shaft 22 coaxially with the second throttle shaft 22 senses an amount of rotation of each of the first and second throttle shafts 21 and 22.

Figure 4:
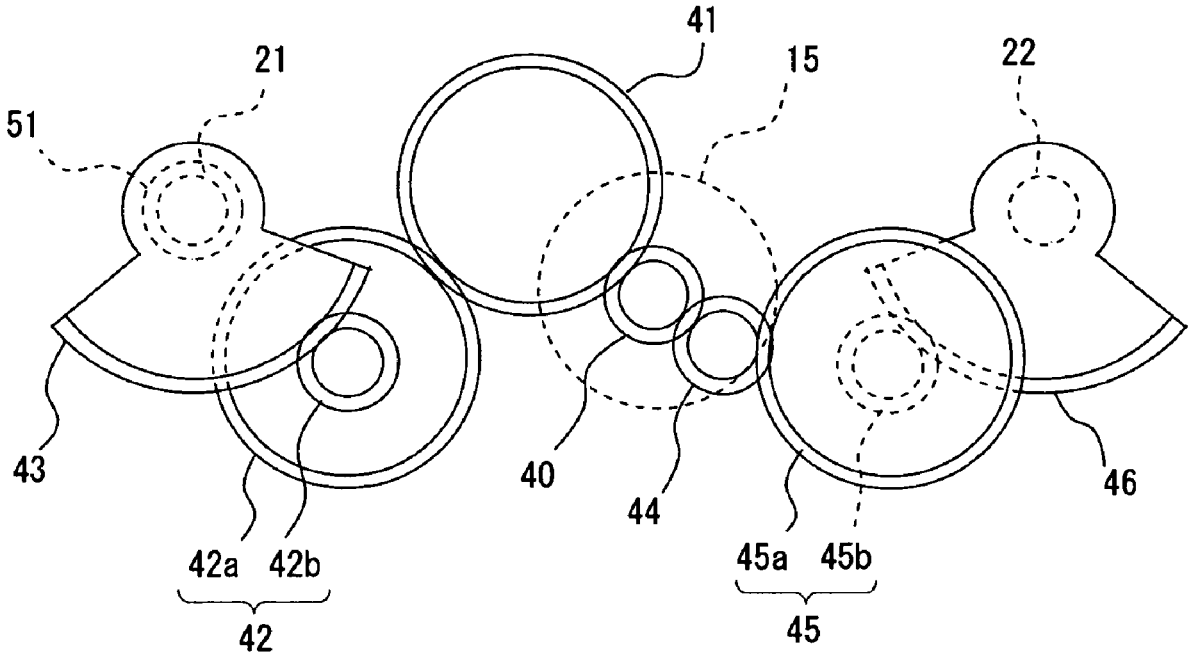
FIG. 4 is a view illustrating arrangement of a motor gear and first to sixth gears, which are housed in the gear case, according to the embodiment.

A description is made here of a transmission route of the drive force to the first throttle shaft 21. FIG. 4 is a view schematically illustrating arrangement of a motor gear 40 and the first to sixth gears 41 to 46. As illustrated in FIGS. 3 and 4, the motor gear 40 provided on the motor 15 meshes with the first gear 41. The first gear 41 meshes with a second-gear large-diameter portion 42*a* corresponding to an outer portion of the second gear 42. The second gear 42 includes a second-gear small-diameter portion 42*b* that is coaxial with the second-gear large-diameter portion 42*a* and has a smaller diameter. The second-gear small-diameter portion 42*b* meshes with the third gear 43. The third gear 43 has a sector shape formed by partially removing a spur gear. A ring tip end portion 51 having a ring shape is integrally fixed onto an axial center portion of the third gear 43. The ring tip end portion 51 has the first throttle shaft 21 inserted thereinto. As described later, the ring tip end portion 51 is one of the constituents of a synchronization mechanism 50. The ring tip end portion 51 is fixed to the third gear 43, and is coupled to the first throttle shaft 21. The ring tip end portion 51 has a size extended from the first shaft hole 31 when the gear cover 12 is fixed to the gear case 11.

A description is made of a transmission route of the drive force to the second throttle shaft 22. The motor gear 40 meshes with the fourth gear 44 in a similar way to the first gear 41. The fourth gear 44 meshes with a fifth-gear large-diameter portion 45*a* of the fifth gear 45. A fifth-gear small-diameter portion 45*b* coaxial with the fifth-gear large-diameter portion 45*a* meshes with the sixth gear 46. The sixth gear 46 has a sector shape formed by partially removing a gear in a similar way to the third gear 43, and is fixed to the second throttle shaft 22 at an axial center portion thereof.

Figure 5:
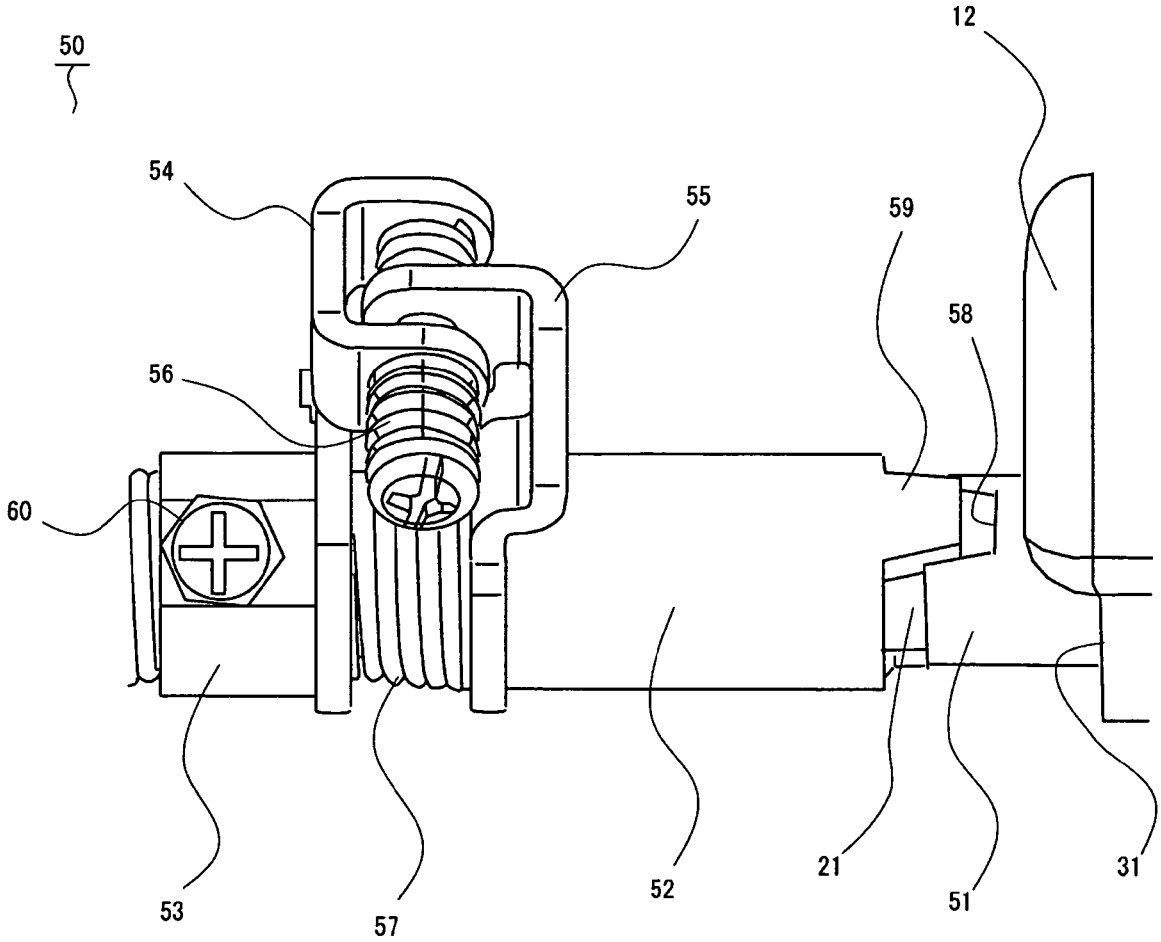
FIG. 5 is a view illustrating a configuration of a synchronization mechanism according to the embodiment.

Next, a description is made of the synchronization mechanism 50. FIG. 5 is a view illustrating a configuration of the synchronization mechanism 50. The synchronization mechanism 50 is a mechanism for adjusting synchronization of the opening and closing operations between the first throttle valve 23*a* and the third throttle valve 23*c*, which are fixed to the first throttle shaft 21, and the second throttle valve 23*b* and the fourth throttle valve 23*d*, which are fixed to the second throttle shaft 22. By the synchronization mechanism 50, opening states of the first to fourth throttle valves 23*a* to 23*d* at the time when the engine is in an idling state are adjusted, whereby an appropriate volume of air is supplied to the engine.

The synchronization mechanism 50 includes the ring tip end portion 51, an annular contact portion 52, a shaft mounting ring 53, a synchronization SP receiving lever 54, a synchronization lever 55, a synchronization screw 56, and a fitting spring 57.

As illustrated in FIG. 5, a fitting recessed portion 58 having a recessed shape is formed on an end portion of the ring tip end portion 51. In a similar way to the ring tip end portion 51, the annular contact portion 52 has a ring shape so as to cover the first throttle shaft 21 in a circumferential direction. On a right-side end portion of the annular contact portion 52, that is, on a third throttle body 20*c*-side end portion thereof, a fitting protruding portion 59 having a protruding shape, which is fittable to the fitting recessed portion 58 of the ring tip end portion 51, is formed.

Onto a left-side end portion of the annular contact portion 52, that is, onto a first throttle body 20*a*-side end portion thereof, the synchronization lever 55 is fixed. More on the left side of the synchronization lever 55, the shaft mounting ring 53 is fixed while interposing the fitting spring 57 therebetween. The synchronization SP receiving lever 54 is fixed onto a right-side end portion of the shaft mounting ring 53. The shaft mounting ring 53 is fixed to the first throttle shaft 21 by a mounting screw 60.

Relative positions of the synchronization SP receiving lever 54 and the synchronization lever 55 in the circumferential direction are made adjustable by the synchronization screw 56. In other words, the synchronization screw 56 is adjusted, whereby the annular contact portion 52 rotates. Then, the fitting protruding portion 59 and the fitting recessed portion 58 fit to each other, whereby the ring tip end portion 51 rotates together with the annular contact portion 52. Then, the third gear 43 fixed to the ring tip end portion 51 rotates. The rotation of the third gear 43 is transmitted sequentially through the second gear 42, the first gear 41, the motor gear 40, the fourth gear 44, the fifth gear 45, and the sixth gear 46, and finally rotates the second throttle shaft 22. The number of teeth of each of the motor gear 40 and the first to sixth gears 41 to 46 is set so that the amount of rotation of the first throttle shaft 21 and the amount of rotation of the second throttle shaft 22 coincide with each other. In such a way, the first to fourth throttle valves 23*a* to 23*d* are synchronized together.

As described above, in the synchronization mechanism 50, two constituent members, which are the ring tip end portion 51 and the annular contact portion 52, are provided as constituent members which transmit, to the third gear 43, the amount of operation made by each of the synchronization SP receiving lever 54 and the synchronization lever 55. Accordingly, ease of assembly of the synchronization mechanism 50 is not damaged. Specifically, it is not necessary to adopt a configuration in which the gear cover 12 is split, in order to assemble the synchronization mechanism 50 therewith. Further, the synchronization lever 55 and the synchronization SP receiving lever 54 are inserted through the first shaft hole 31 in the event of the assembly described above, and accordingly, it is not necessary to increase a size of the first shaft hole 31, whereby the gear cover 12 can be hermetically sealed as appropriate.

Further, the ring tip end portion 51 and the annular contact portion 52 are configured to be coupled to each other in such a manner that the fitting recessed portion 58 and the fitting protruding portion 59 are taper-fitted to each other, and further, the fitting spring 57 is configured to urge the annular contact portion 52 in a direction of the ring tip end portion 51. Accordingly, even in the case where dimensions of the fitting recessed portion 58 and the fitting protruding portion 59 are changed owing to abrasion thereof, the fitting of the fitting recessed portion 58 and the fitting protruding portion 59 is maintained as appropriate, and functions of the synchronization mechanism 50 can be properly kept.

Figure 6:
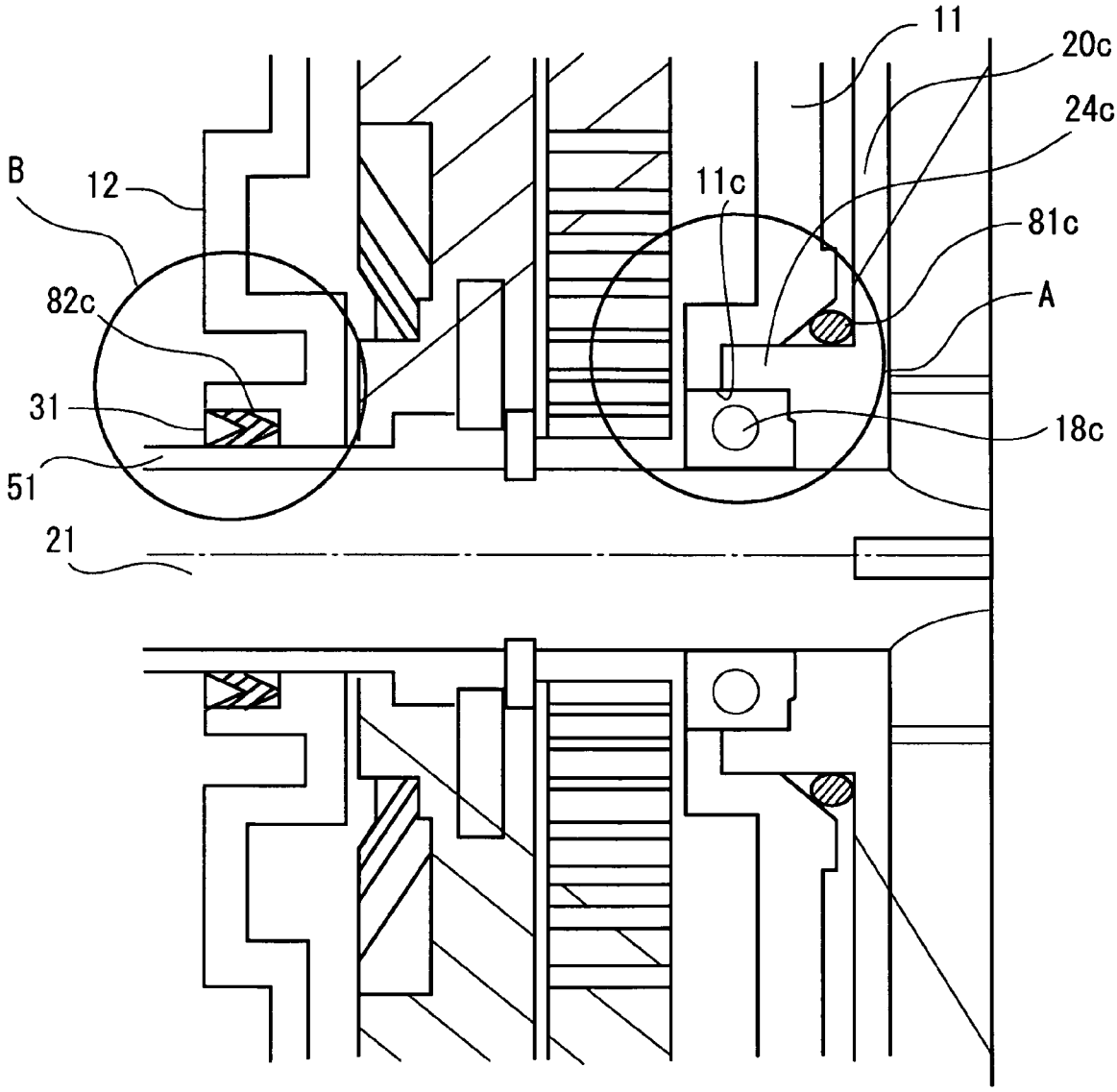
FIG. 6 is a view illustrating a mounting state of the gear case and a throttle body according to the embodiment.

In this case, as illustrated in FIG. 6, on a region of an outer circumference of the third throttle body 20*c*, which the throttle shaft 21 passes through, a cylindrical boss 24*c* is protruded integrally therewith. A bearing 18*c* of the throttle shaft 21 is fitted and held onto the cylindrical boss 24*c*. The bearing 18*c* is also fitted to a through hole 11*c* formed in the gear case 11. In such a way, by the bearing 18*c*, the throttle shaft 21 is freely rotatably supported on the gear case 11 and the third throttle body 20*c*. Although not illustrated, a region of an outer circumference of the fourth throttle body 20*d*, which the throttle shaft 22 passes through, has a similar configuration in which the throttle shaft 22 is freely rotatably supported on the gear case 11 and the fourth throttle body 20*d* by a bearing 18*d* fitted to a through hole 11*d* of the gear case 11 and a cylindrical boss 24*d* of the fourth throttle body 20*d*.

Further, a seal member 81*c* such as an O-ring is interposed in a gap between the gear case 11 and the cylindrical boss 24*c* of the third throttle body 20*c*. Further, a seal member 82*c* such as a V-seal is interposed in the shaft hole 31 of the gear cover 12, which the throttle shaft 21 and the ring tip end portion 51 pass through. The seal member 82*c* is interposed between the gear cover 12 and the ring tip end portion 51 provided on an outer circumference of the throttle shaft 21. In a similar way, a seal member 81*d* such as an O-ring is interposed in a gap between the gear case 11 and the cylindrical boss 24*d*, and a seal member 82*d* such as a V-seal is interposed in the shaft hole 32.

As described above, the seal member 81*c* is interposed between the gear case 11 and the throttle body 20*c*, and the seal member 81*d* is interposed between the gear case 11 and the throttle body 20*d*, and in addition, the seal members 82*c* and 82*d* are interposed in the shaft holes 31 and 32 of the gear cover 12, respectively. Accordingly, sealing property of the gear case 11 is enhanced by sealing functions brought by those sealing members 81*c*, 81*d*, 82*c*, and 82*d*, and invasion of mud, water, and the like from the outside into the gear case 11 is surely prevented, whereby smooth operations of the gears 40 to 46 in the gear case 11 are ensured.

The description has been made above of the present invention on the basis of the embodiment. Those skilled in the art understand that this embodiment is illustratively described, that a variety of modifications are possible for combinations of the respective constituents and the respective processing processes, and that those modifications are also incorporated in the scope of the present invention.

What is claimed is:

1. A multiple throttle device, comprising:

two or more throttle bodies;

two throttle shafts, each being rotatably supported on the two or more throttle bodies;

drive means for driving the two throttle shafts;

drive force transmission means for transmitting the drive force of the drive means to the two throttle shafts, the drive force transmission means being arranged between the two or more throttle bodies rotatably supporting the same throttle shaft; and a drive force transmission means housing case, the drive force transmission means housing case housing the drive force transmission means therein, and coupling two throttle bodies to each other, the two throttle bodies being individually fixed to the two throttle shafts different from each other.

2. The multiple throttle device according to claim 1, wherein the drive means is installed in an area surrounded by four pieces of the throttle bodies.

3. The multiple throttle device according to claim 1, wherein the drive force transmission means comprises gears.

4. The multiple throttle device according to claim 2, wherein the drive force transmission means comprises gears.

5. The multiple throttle device according to claim 3, further comprising a synchronization mechanism fixed to one of the two throttle shafts, the synchronization mechanism including a synchronization screw, wherein the synchronization mechanism synchronizes, to each other, sets of the throttle bodies rotatably supporting the different two throttle shafts in such a manner that a mesh degree of the gears is adjusted by the synchronization screw.

6. The multiple throttle device according to claim 5, wherein the synchronization mechanism comprises:

a first adjustment section, which is fixed to the one of the two throttle shafts, and is extended from the drive force transmission means housing case; and a second adjustment section, which has an operation portion receiving an adjustment operation, is fixed to the one of the two throttle shafts, and fits to the first adjustment section.

7. The multiple throttle device according to claim 6, wherein the synchronization mechanism comprises urging means for retaining fitting between the first adjustment section and the second adjustment section.

8. The multiple throttle device according to claim 6, wherein the first adjustment section and the second adjustment section are taper-fitted to each other.

9. The multiple throttle device according to claim 7, wherein the first adjustment section and the second adjustment section are taper-fitted to each other.

10. The multiple throttle device according to claim 4, further comprising a synchronization mechanism fixed to one of the two throttle shafts, the synchronization mechanism including a synchronization screw, wherein the synchronization mechanism synchronizes, to each other, sets of the throttle bodies rotatably supporting the different two throttle shafts in such a manner that a mesh degree of the gears is adjusted by the synchronization screw.

11. The multiple throttle device according to claim 10, wherein the synchronization mechanism comprises:

a first adjustment section, which is fixed to the one of the two throttle shafts, and is extended from the drive force transmission means housing case; and a second adjustment section, which has an operation portion receiving an adjustment operation, is fixed to the one of the two throttle shafts, and fits to the first adjustment section.

12. The multiple throttle device according to claim 11, wherein the synchronization mechanism comprises urging means for retaining fitting between the first adjustment section and the second adjustment section.

13. The multiple throttle device according to claim 11, wherein the first adjustment section and the second adjustment section are taper-fitted to each other.

14. The multiple throttle device according to claim 12, wherein the first adjustment section and the second adjustment section are taper-fitted to each other.

15. A multiple throttle device where multiple throttle shafts are driven by a single drive force, comprising:

first, second, third and fourth throttle bodies;

a first throttle shaft to which the first and third throttle bodies are fixed;

a second throttle shaft to which the second and fourth throttle bodies are fixed, the first throttle shaft and the second throttle shaft being parallel to each other;

a gear case, the third throttle body and the fourth throttle body being integrally coupled to each other in the gear case;

a motor to drive the first throttle shaft and the second throttle shaft arranged in the gear case;

a plurality of gears to transmit drive force of the motor to the first throttle shaft and the second throttle shaft.

16. The multiple throttle device according to claim 15, further comprising a synchronization mechanism to adjust synchronization of opening and closing operations between the first and third throttle bodies, which are fixed to the first throttle shaft, and the second and fourth throttle bodies, which are fixed to the second throttle shaft.

17. The multiple throttle device according to claim 16, wherein the synchronization mechanism comprises:

a first adjustment section, which is fixed to the one of the two throttle shafts, and is extended from the gear case; and a second adjustment section, which has an operation portion receiving an adjustment operation, is fixed to the one of the two throttle shafts, and fits to the first adjustment section.

18. The multiple throttle device according to claim 17, wherein the synchronization mechanism further comprises a fitting spring to retain fitting between the first adjustment section and the second adjustment section.

19. The multiple throttle device according to claim 17, wherein the first adjustment section and the second adjustment section are taper-fitted to each other.

* * * * *